United States Patent [19]

Höfer

[11] Patent Number: 4,627,609

[45] Date of Patent: Dec. 9, 1986

[54] SHEET DELIVERY DEVICE, ESPECIALLY FOR SMALL OFFSET PRINTING MACHINE

[75] Inventor: Gottfried Höfer, Mauer, Fed. Rep. of Germany

[73] Assignee: Heidelberger Druckmaschinen AG, Heidelberg, Fed. Rep. of Germany

[21] Appl. No.: 723,091

[22] Filed: Apr. 15, 1985

[30] Foreign Application Priority Data

Apr. 13, 1984 [DE] Fed. Rep. of Germany ..... 3413943

[51] Int. Cl.[4] ..... B65H 29/54

[52] U.S. Cl. ..... 271/311; 101/142; 271/82; 271/314; 271/900

[58] Field of Search ..... 271/307, 311, 312, 313, 271/314, 82, 900; 101/142, 217, 251, 407 H

[56] References Cited

U.S. PATENT DOCUMENTS

| | | | |
|---|---|---|---|
| 1,537,645 | 5/1925 | Low | 271/314 |
| 1,741,848 | 12/1929 | Kelly | 271/307 X |
| 2,531,253 | 11/1950 | Carden | 271/314 |
| 2,844,372 | 7/1958 | Liebenow | 271/312 |

FOREIGN PATENT DOCUMENTS

| | | | |
|---|---|---|---|
| 266650 | 8/1929 | Italy | 271/900 |

*Primary Examiner*—Richard A. Schacher

*Attorney, Agent, or Firm*—Herbert L. Lerner; Laurence A. Greenberg

[57] ABSTRACT

A sheet delivery device for a printing machine wherein a sheet is peeled from an impression cylinder and introduced into a nip formed between two conveyor rollers rolling on one another includes a sheet guiding device located downstream of the conveyor rollers in travel direction of a peeled sheet, guide rollers for a trailing region of the peeled sheet, the guide rollers being in operative engagement with the impression cylinder, a carrying element carrying and uniting the conveyor rollers, the sheet guiding device and the guide rollers into a single unit so that they are adjustable in common therewith to a selected format width, and adjusting means carried by the carrying element for adjusting respective forces of application of the conveyor rollers and the guide rollers.

9 Claims, 4 Drawing Figures

SHEET DELIVERY DEVICE, ESPECIALLY FOR SMALL OFFSET PRINTING MACHINE

The invention relates to a sheet delivery device, especially for small offset printing machines, wherein a sheet is peeled from an impression cylinder and introduced into a gap or nip between two conveyor rollers rolling on one another, guide rollers for the trailing part of the sheet being peeled from the impression cylinder being associated with the impression cylinder in vicinity of the sheet delivery device.

Sheet delivery devices of the foregoing general type are in use in small offset printing machines as well as also, in at least similar form, in units or apparatuses for copying, duplicating or printing for office or other commercial or business purposes.

For proper and troublefree paper-sheet delivery, it is necessary that the sheet delivery device and various component parts of the sheet delivery device, respectively, such as are mentioned hereinbefore, be adjustable, respectively, as a whole and with respect to one another. These necessities result, for example, from varying format widths and thicknesses of the sheets.

In this respect, the heretofore known state of the art reveals disadvantages, especially with regard to operation and adjustability. Thus, for example, the format-width is generally adjustable only when the printing machine is at standstill; furthermore, the conveyor rollers, which are constructed for the most part as profiling and application rollers (under their own weight), can be adjusted only individually in longitudinal direction of the cylinder, the application pressure between the profiling and application roller being nonadjustable, moreover, and hence incapable of being matched to the various types of papers.

In view of these disadvantages of the prior state of the art, it is an object of the invention, to provide a sheet delivery device, especially for small offset printing machines, which affords simple and problem free operation with regard to adjustment of the format-width and the respective application pressure of the rollers which are provided and, in addition thereto, which ensures gentle handling of the sheet to be delivered.

With the foregoing and other objects in view, there is provided, in accordance with the invention, a sheet delivery device for a printing machine wherein a sheet is peeled from an impression cylinder and introduced into a nip formed between two conveyor rollers rolling on one another, comprising a sheet guiding device located downstream of the conveyor rollers in travel direction of a peeled sheet, guide rollers for a trailing region of the peeled sheet, the guide rollers being in operative engagement with the impression cylinder, a carrying element carrying and uniting the conveyor rollers, the sheet guiding device and the guide rollers into a single unit so that they are adjustable in common therewith to a selected format width, and adjusting means carried by the carrying element for adjusting respective forces of application of the conveyor rollers and the guide rollers.

In accordance with another feature of the invention, there is provided another carrying element, a respective one of the guide rollers, and one of the two conveyor rollers acting as an application roller are arranged on each of the carrying elements, one of the carrying elements being disposed at a location adjacent the left-hand side of the sheet and the other of the carrying elements being disposed at a location adjacent the right-hand side of the sheet, the carrying elements being mounted laterally slidable and lockable on cross bars extending across the width of the printing machine, the other of the two conveyor rollers cooperating with the one conveyor roller acting as an application roller and being mounted axially displaceably on a drive shaft likewise extending across the width of the printing machine, the other conveyor roller being in entraining connection with the carrying element.

In accordance with an added feature of the invention, the carrying element is constructed as an elongated bearing block displaceable in axial direction on a flattened round shaft and fixable by means of a capstan-headscrew, the flattened round shaft being fastened by fastening screws to side walls of the printing machine, the carrying element being additionally braced by a bifurcated projection on another shaft mounted on the two side walls of the printing machine also by means of fastening screws.

In accordance with a further feature of the invention, the entraining connection between the other conveyor roller and the carrying element comprises a bracket releasably fastened to a lower flattened side of the carrying element and embracing the other of the two conveyor rollers.

In accordance with an additional feature of the invention, there are provided adjusting means engaging the carrying element for adjusting and displacing the bracket relative to the carrying element in a direction as viewed across the width of the printing machine.

In accordance with again a further feature of the invention, the adjusting means comprises knurled nuts engaging a strap of the bracket for laterally adjusting the bracket and thus the other conveyor roller with respect to the guide roller and the one conveyor roller arranged on the carrying element, the knurled nuts being screwed onto a threaded pin engaging in a threaded bore formed in the carrying element.

In accordance with again an additional feature of the invention, the other conveyor roller is constructed as a cylindrical rubber roller, and including a guide plate for guiding the sheet disposed downstream of the other conveyor roller in travel direction of the sheet, the guide plate being fastened to a bracket secured to the carrying element.

In accordance with again an added feature of the invention there are provided gears of a drive chain acting upon the drive shaft of the other conveyor roller, the other conveyor roller being drivable by the gears.

In accordance with still an added feature of the invention, the adjusting means comprise an adjustable adjusting device operatively associated with the one conveyor roller which acts as an application roller, the adjusting device being integrated into the carrying element.

In accordance with still an additional feature of the invention, there are provided bearing means for supporting the one conveyor roller by a rotational shaft thereof on the carrying element via a first lever connected at one end thereof to the rotational shaft, the first lever carrying at the other end thereof a bearing pin for the one conveyor roller, an application force being transmittable to the other conveyor roller from the one conveyor roller via the first lever and the adjusting device, the adjusting device including a pin engaging the first lever and extending into a bore formed in the carrying element, a compression spring engaging the pin for applying the application force thereto, and an adjusting screw for presetting the application force in the compression spring.

In accordance with still a further feature of the invention, the guide roller is mounted so as to be freely rotatable, respectively, on a second lever, the second lever being supported on a bearing pin of the carrying element located at a region thereof facing towards the impression cylinder, the second lever being resiliently braced against the carrying element via another compression spring surrounding a guide pin having a nut and locknut threadedly tightened thereon.

In accordance with a concomitant feature of the invention, there is provided a stripping device located adjacent the conveyor rollers for peeling the sheet off the impression cylinder, the stripping device comprising a rail extending across the width of the printing machine and being secured by fastening screws to the side walls of the printing machine, the rail having stripper fingers thereon.

Other features which are considered as characteristic for the invention are set forth in the appended claims.

Although the invention is illustrated and described herein as embodied in a sheet delivery device, especially for small offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
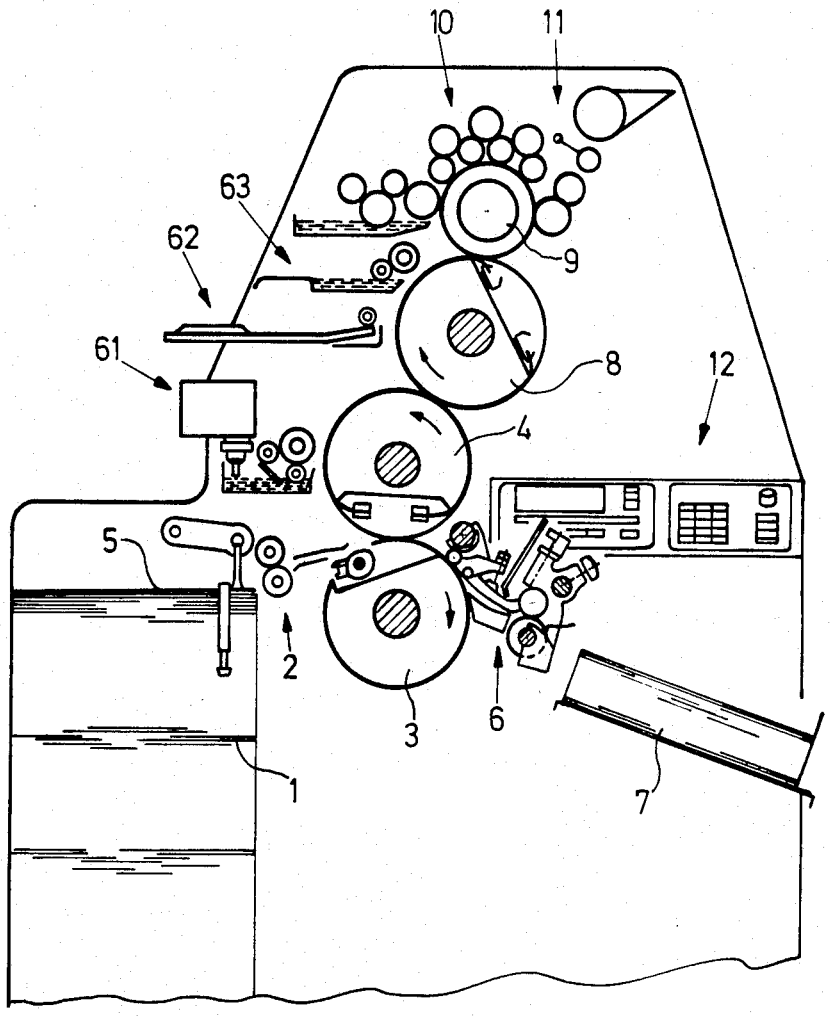
FIG. 1 is a diagrammatic side elevational view of the upper region of a small offset printing press having a sheet-delivery device according to the invention.

Referring now to the drawing and first, particularly, to FIG. 1 thereof, there is shown a small offset printing press wherein a sheet 5 to be printed is isolated or individually separated from a pile 1 and fed to an impression cylinder 3 via a feeding device 2.

Transfer of the printed image occurs in a gap or nip between the impression cylinder 3 and a rubber or blanket cylinder 4. The printed sheet 5 is then taken over by a sheet delivery device 6 and fed to a delivery pile 7. The rubber or blanket cylinder 4 receives the printed image from a plate cylinder 8 preceding the blanket cylinder 4, the plate cylinder 8 receiving the printing ink via an applicator roller 9 which is in contact with an inking and dampening unit 10, 11. The printing press receives relevant commands from a press operator by way of a control panel 12. Other essential component parts of the printing press are a rubber blanket washing device 61, a foil infeeding device 62 and an etching device 63.

Figure 2:
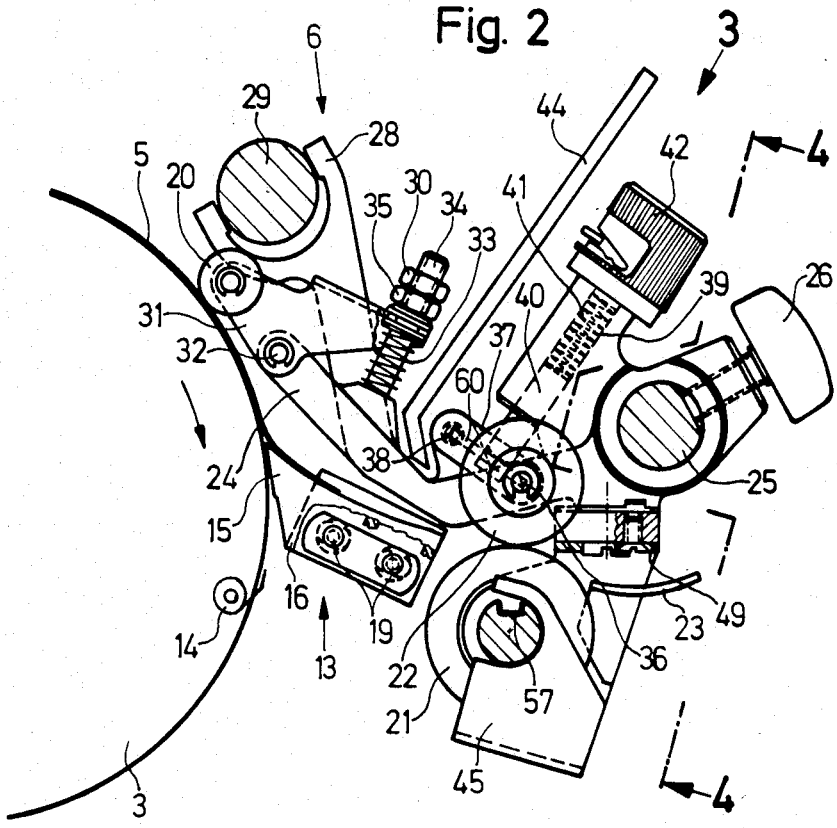
FIG. 2 is an enlarged fragmentary view of FIG. 1 showing the sheet-delivery device according to the invention.
Figure 3:
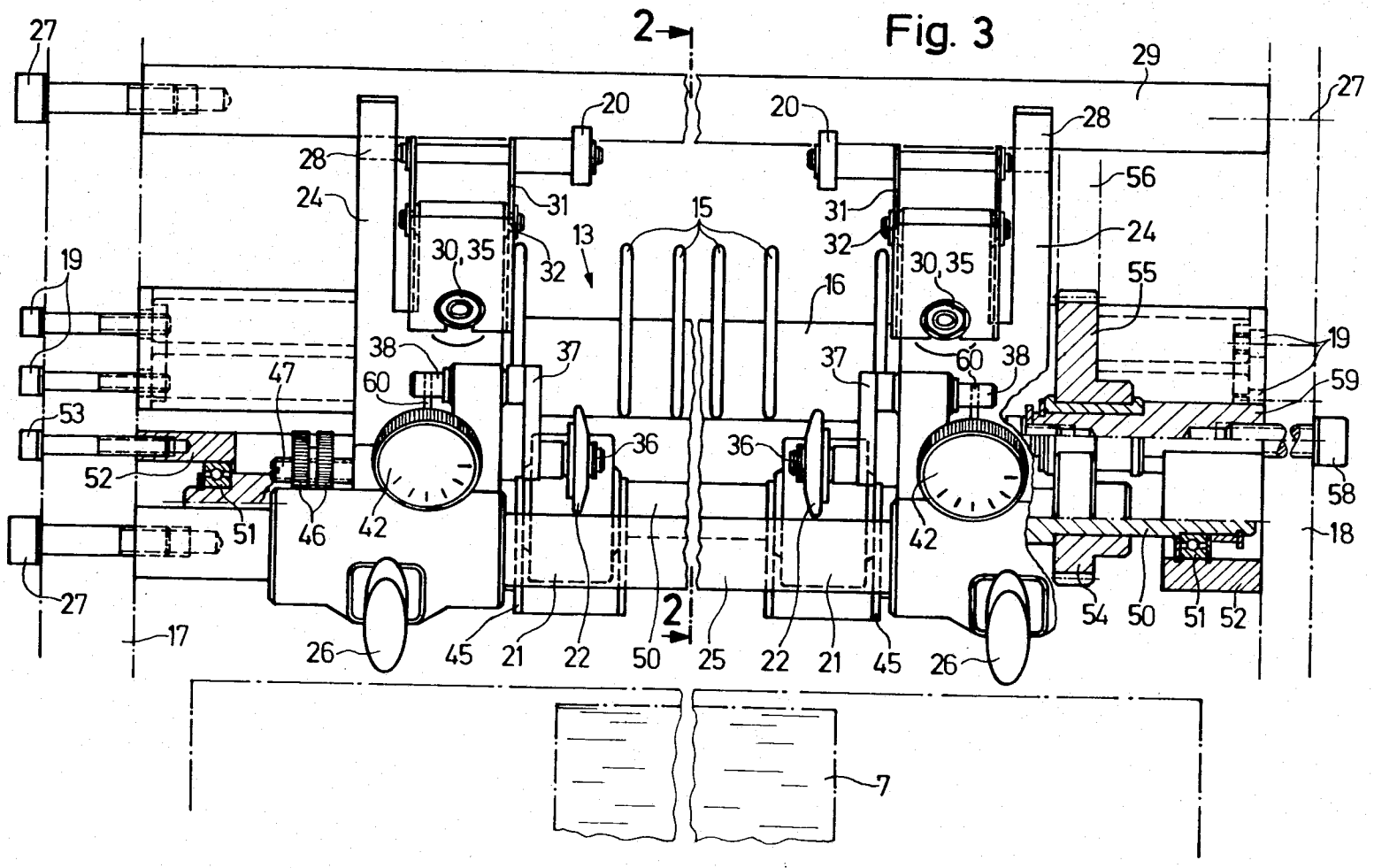
FIG. 3 is a perspective view of FIG. 2 as seen in direction of the arrow 3 in FIG. 2.

FIG. 2 is an enlarged view of the sheet delivery device 6 which is associated with the impression cylinder 3. A stripper or sheet remover 13 is provided for loosening or detaching from the impression cylinder 3 the sheet 5 released by sheet grippers 14, and for feeding the sheet 5 to conveyor rollers 21 and 22 disposed downstream therefrom. The sheet remover or stripper 13 is formed of a plurality of sheet-removing or stripping fingers 15 arranged suitably across the width of the machine, and carried by a rail 16 with which it is fastened to side walls 17 and 18 of the printing machine via fastening screws 19 (FIG. 3). After the sheet 5 has been related by the sheet grippers 14 and the leading edge of the sheet 5 has been lifted away, the trailing area of the sheet 5 is held in contact with the impression cylinder 3 via a guide roller 20 engaging the impression cylinder 3 until the sheet 5 is taken over by the conveyor rollers 21 and 22.

The conveyor rollers 21 and 22, as seen across the width of the sheet, are formed as cylindrical rubber rollers 21 and pressure rollers 22 associated with the left-hand and right-hand sides of the sheet and being applied against the rubber rollers 21 with a given application force. The application force is adjustable via a device which is described hereinafter in greater detail.

Respective guide plates 23, arranged on the left-hand and right-hand sides, are provided downstream from the conveyor rollers 21 and 22 i.e. especially after the rubber roller 21, each of the guide plates 23 being of such shape that a slight curvature or bow is imparted to the sheet 5 to be delivered so that the inner stability of the sheet 5 is enhanced, thereby rendering the further travel of the sheet 5 to the delivery pile 7 more trouble-free.

The guide roller 20 and the application or the one conveyor roller 22 are mounted on a carrying element 24 constructed as an elongated bearing block which is displaceable in an axial direction on a somewhat flattened round shaft 25 and is fixable by means of a capstan-head screw 26. The flattened round shaft 25 is secured to side walls 17 and 18 of the printing machine by means of fastening screws or mounting bolts 27. The carrying element 24 is supported on another shaft 29 by means of a fork-shaped projection 28, the mounting support for the shaft 29 being likewise at the two side walls 17 and 18 and being effected by means of fastening screws or mounting bolts 27.

Each guide roller 20 is furthermore rotatably mounted on a lever 31 which is, in turn, pivotable about a bearing pin 32 of the carrying element 24 and is resiliently or springily braced against the carrying element 24 via a compression spring 33, a guide pin 34 and a nut 35 with an associated locknut 30 so that the guide roller 20 rests against the impression cylinder 3 with a presettable application pressure.

The mounting support for the application or other conveyor roller 22 on the carrying element 24 is also effected by means of an axle or shaft journal 36 and via a lever 37, the other end of the lever 37 being connected to the carrying element 24 via a bearing pin 38. The application force is transferred via another lever 60, connected to the bearing pin 38, to the application roller 22 via a pin 40 which extends into a bore 39 formed in the carrying element 24, a compression spring 41 exerting a biasing force on the pin 40.

The application force can be varied by means of an adjusting screw 42 acting upon the compression spring 41, the adjusting screw 42 having a predetermined adjusting range. The adjusting range extends, for example, over less than one turn of the screw.

A guard plate 44 is provided between the capstan-head screw 26 as well as the adjusting screw or setscrew 42 and that region of the sheet delivery device 6 facing towards the impression cylinder 3. Ease of access to the aforementioned adjusting elements is thereby afforded.

The rubber roller 21 as well as the guide plate 23 are connected to the carrying element 24 by means of a bracket 45. The rubber roller 21 and the guide plate 23 are thus laterally displaced simultaneously with the application roller 22. The guide plate 23 and the rubber roller 21 can moreover by adjusted laterally relative to the application roller 22 by means of knurled nuts 46 which act upon a strap 43 of the bracket 45.

Figure 4:
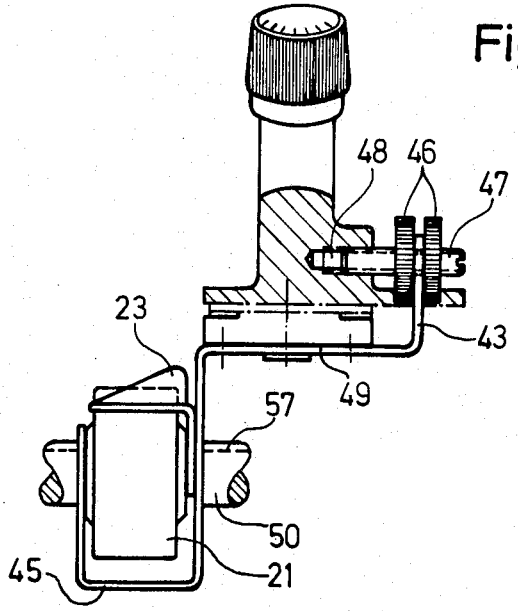
FIG. 4 is a sectional view of FIG. 2 taken along the line 4—4 in direction of the arrows.

As is apparent from FIG. 4, the knurled nuts are screwed onto a threaded rod 47 which engages in a threaded bore formed in the carrying element 24. The bracket 45 is releasably mounted on the lower flattened side 49 of the carrying element 24 and is accordingly laterally movable and, moreover, embraces the rubber roller 21.

The rubber roller 21, which is provided with a slight sliding fit, is mounted on a drive shaft 50 formed with a longitudinal groove 57 and, because of the entrainment connection thereof with the bracket 45, can readily be displaced in axial direction.

The drive shaft 50 is mounted in axle or shaft supports 52 through the intermediary of ball bearing 51, the shaft supports 52 being secured, respectively, to the two side walls 17 and 18 of the printing machine, by fastening screws or mounting bolts 53.

A gear 54 mounted on the drive shaft 50 so as to be fixed against relative rotation therewith transmits the rotational movement to the drive shaft 50 via other gears 55 and 56 of the drive chain. The associated gear 55 is rotatably mounted on a bearing pin 59 held in place on the side wall 18 by fastening screws or mounting bolts 58.

By virtue of its construction, as aforedescribed, a material advantage of the sheet delivery device according to the invention is, also that all adjusting and setting tasks may be performed even while the printing machine is in operation.

The foregoing is a description corresponding in substance to German Application No. P 34 13 943.5, dated Apr. 13, 1984, the International priority of which is being claimed for the instant application, and which is hereby made part of this application. Any material discrepancies between the foregoing specification and the aforementioned corresponding German application are to be resolved in favor of the latter.

I claim:

1. Sheet delivery device for a printing machine wherein a sheet is peeled from an impression cylinder and introduced into a nip formed between two conveyor rollers rolling on one another, comprising a sheet guiding device located downstream of the conveyor rollers in travel direction of a peeled sheet, guide rollers for a trailing region of the peeled sheet, said guide rollers being in operative engagement with the impression cylinder, a carrying element carrying and uniting the conveyor rollers, said sheet guiding device and said guide rollers into a single unit so that they are adjustable in common therewith to a selected format width, adjusting means carried by said carrying element for adjusting respective forces of application of the conveyor rollers and said guide rollers and including another carrying element, a respective one of said guide rollers, and one of the two conveyor rollers acting as an application roller being arranged on each of said carrying elements, one of said carrying elements being disposed at a location adjacent the left-hand side of the sheet and the other of said carrying elements being disposed at a location adjacent the right-hand side of the sheet, said carrying elements being mounted laterally slidable and lockable on cross bars extending across the width of the printing machine, the other of said two conveyor rollers cooperating with said one conveyor roller acting as an application roller and being mounted axially displaceably on a drive shaft likewise extending across the width of the printing machine, said other conveyor roller being in entraining connection with said carrying element, and including adjusting means engaging said carrying element for adjusting and displacing said bracket relative to said carrying element in a direction as viewed across the width of the printing machine, said adjusting means comprising knurled nuts engaging a strap of a bracket forming said entraining connection for laterally adjusting said bracket and thus said other conveyor roller with respect to said guide roller and said one conveyor roller arranged on said carrying element, said knurled nuts being screwed onto a threaded pin engaging in a threaded bore formed in said carrying element.

2. Sheet delivery device according to claim 1, wherein said carrying element is constructed as an elongated bearing block displaceable in axial direction on a shaft and fixable by means of a capstan-headscrew, said shaft being fastened by fastening screws to side walls of the printing machine, said carrying element being additionally braced by a bifurcated projection on another shaft mounted on the two side walls of the printing machine also by means of fastening screws.

3. Sheet delivery device according to claim 1, wherein said bracket forming said entraining connection between said other conveyor roller and said carrying element is releasably fastened to a lower flattened side of said carrying element and embracing said other of said two conveyor rollers.

4. Sheet delivery device according to claim 1, wherein said other conveyor roller is constructed as a cylindrical rubber roller, and including a guide plate for guiding the sheet disposed downstream of said other conveyor roller in travel direction of the sheet, said guide plate being fastened to a bracket secured to said carrying element.

5. Sheet delivery device according to claim 4 including gears of a drive system acting upon said drive shaft of said other conveyor roller, said other conveyor roller being drivable by said gears.

6. Sheet delivery device according to claim 1, wherein said adjusting means comprise an adjusting device operatively associated with said one conveyor roller which acts as an application roller, said adjusting device being integrated into said first mentioned carrying element.

7. Sheet delivery device according to claim 1, wherein said guide roller is mounted so as to be freely rotatable, respectively, on a second lever, said second lever being supported on a bearing pin of said carrying element located at a region thereof facing towards the impression cylinder, said second lever being resiliently braced against said carrying element via another compression spring surrounding a guide pin having a nut and locknut threadedly tightened thereon.

8. Sheet delivery device according to claim 1, including a stripping device located adjacent said conveyor rollers for peeling the sheet off the impression cylinder, said stripping device comprising a rail extending across the width of the printing machine and being secured by fastening screws to the side walls of the printing machine, said rail having stripper fingers thereon.

9. Sheet delivery device for a printing machine wherein a sheet is peeled from an impression cylinder and introduced into a nip formed between two conveyor rollers rolling on one another, comprising a sheet guiding device located downstream of the conveyor rollers in travel direction of a peeled sheet, guide rollers for a trailing region of the peeled sheet, said guide rollers being in operative engagement with the impression cylinder, a carrying element carrying and uniting the conveyor rollers, said sheet guiding device and said guide rollers into a single unit so that they are adjustable in common therewith to a selected format width, adjusting means carried by said carrying element for adjusting respective forces of application of the conveyor rollers and said guide rollers and including another carrying element, a respective one of said guide rollers, and one of the two conveyor rollers acting as an application roller being arranged on each of said carrying elements, one of said carrying elements being disposed at a location adjacent the lefthand side of the sheet and the other of said carrying elements being disposed at a location adjacent the right-hand side of the sheet, said carrying elements being mounted laterally slidable and lockable on cross bars extending across the width of the printing machine, the other of said two conveyor rollers cooperating with said one conveyor roller acting as an application roller and being mounted axially displaceably on a drive shaft likewise extending across the width of the printing machine, said other conveyor roller being in entraining connection with said carrying element, said adjusting means comprising an adjusting device operatively associated with said one conveyor roller which acts as an application roller, said adjusting device being integrated into said first mentioned carrying element, and including bearing means for supporting said one conveyor roller by a rotational shaft thereof on said carrying element via a first lever connected at one end thereof to said rotational shaft, said first lever carrying at the other end thereof a bearing pin for said one conveyor roller, an application force being transmittable to said other conveyor roller from said one conveyor roller via said first lever and said adjusting device, said adjusting device including a pin engaging said first lever and extending into a bore formed in said carrying element, a compression spring engaging said pin for applying said application force thereto, and an adjusting screw for presetting said application force in said compression spring.

* * * * *